US006169864B1

(12) United States Patent
Baxendell et al.

(10) Patent No.: US 6,169,864 B1
(45) Date of Patent: Jan. 2, 2001

(54) TONER CONTAINER INCLUDING A MOVABLY MOUNTED SEALING MEMBER

(75) Inventors: Douglas J. Baxendell, Fairport; Clifford W. Imes, IV, Rochester, both of NY (US)

(73) Assignee: Xerox Corporation, Stamford, CT (US)

( * ) Notice: Under 35 U.S.C. 154(b), the term of this patent shall be extended for 0 days.

(21) Appl. No.: 09/347,568

(22) Filed: Jul. 6, 1999

(51) Int. Cl.[7] ..... G03G 15/08
(52) U.S. Cl. ..... 399/106; 399/258; 399/262
(58) Field of Search ..... 399/106, 258, 399/262; 222/DIG. 1

(56) References Cited

U.S. PATENT DOCUMENTS 5,150,162 * 9/1992 Saito ..... 399/262 X
5,370,270 12/1994 Adams et al. ..... 222/88
5,383,502 1/1995 Fisk et al. ..... 141/364
5,455,662 * 10/1995 Ichikawa et al. ..... 222/DIG. 1
5,495,323 * 2/1996 Meetze, Jr. ..... 222/DIG. 1
5,508,794 * 4/1996 Ikesue et al. ..... 399/262 X
5,576,816 * 11/1996 Staudt et al. ..... 399/262
5,613,177 * 3/1997 Meetze, Jr. et al. ..... 399/262 X
5,678,121 * 10/1997 Meetze, Jr. et al. ..... 399/262 X
5,857,129 1/1999 Harris ..... 399/12
5,890,040 * 3/1999 Matsuoka et al. ..... 399/262

* cited by examiner

*Primary Examiner*—William J. Royer

(57) ABSTRACT

A container for storing a supply of toner therein includes a housing having an open end. A sealing member is mounted movably in the open end of the housing. The sealing member is adapted to move from a closed position sealing the open end of the housing to an open position enabling discharge of toner from the open position of the housing. A spring, in engagement with the sealing member, resiliently urges the sealing member from the open position to the closed position. In this way, the toner cartridge is sealed when remote from the printing machine and opens in response to being placed in the operative position in the printing machine.

9 Claims, 4 Drawing Sheets

TONER CONTAINER INCLUDING A MOVABLY MOUNTED SEALING MEMBER

This invention relates generally to a container for storing a supply of toner therein, and more particularly concerns sealing of the dispensing port located in the toner container.

A typical electrophotographic printing machine employs a photoconductive member that is charged to a substantially uniform potential so as to sensitize the surface thereof. The charged portion of the photoconductive member is exposed to a light image of an original document being reproduced. Exposure of the charged photoconductive member selectively dissipates the charge thereon in the irradiated areas to record an electrostatic latent image on the photoconductive member corresponding to the informational areas contained within the original document. After the electrostatic latent image is recorded on the photoconductive member, the latent image is developed by bringing a developer material into contact therewith. Generally, the electrostatic latent image is developed with dry developer material comprising carrier granules having toner particles that adhere electrically thereto. However, a liquid developer material may be used as well. The toner particles are attracted to the latent image forming a visible powder image on the photoconductive surface. After the electrostatic latent image is developed with the toner particles, the toner powder image is transferred to a sheet. Thereafter, the toner powder image is heated to permanently fuse it to the sheet.

As the toner within the developer material is transferred to the photoconductive member and eventually to the sheet, this used toner must be replaced. The electrophotographic printing machine includes a toner container or cartridge from which fresh toner is dispensed into the machine. When all of the toner is consumed within the printing machine, additional toner must be supplied to the machine. Presently, printing machines are supplied with replaceable toner cartridges. It is highly desirable that these toner cartridges be "white glove." By that it is meant that the operator's hands do not get dirty when they are replacing toner cartridges within the printing machine. Hence, when the toner cartridge is opened to dispense toner particles into the printing machine, none of these toner particles should escape dirtying the hands of the operator or into other areas of the printing machine resulting in contamination thereof. Thus, the toner cartridge must be sealed as it is placed in the printing machine and resealed as it is removed therefrom in order to prevent this kind of contamination on both the printing machine subcomponents and the operator.

Cylindrical toner cartridges are now being used in printing machines. These toner cartridges have spiral ribs located therein. Thus, when the cartridge is rotated, the spiral ribs urge the toner to one end thereof. These cartridges have an opening in the periphery of the container near that end through which the toner escapes. The toner cartridge mates with an opening in the printing machine so that the toner particles are discharged from the opening in the toner cartridge into the printing machine and received in the developer unit thereof. Prior to being placed in the printing machine, the opening in the toner cartridge is typically covered with a removable seal to insure that toner particles do not escape therefrom during the shipment and handling of the cartridge. The seal is removed prior to installation of the toner cartridge in the printing machine.

The following patent may be relevant to aspects of the present invention:

U.S. Pat. No. 5,857,129

Patentee: Harris

Issued: Jan. 5, 1999

The relevant portions of the foregoing patent may be briefly summarized as follows:

U.S. Pat. No. 5,857,129 discloses a cylindrical toner cartridge having an opening at one end thereof. Spiral ribs are molded into the container so that as the container is rotated about its longitudinal axis, toner particles are advanced from one end thereof to the opening therein so as to be dispensed into the developer unit of the printing machine. A seal closes the opening in the container so that particles may not escape therefrom during the shipment and handling thereof.

In accordance with one aspect of the features of the present invention, there is provided a container for storing a supply of toner therein. The container includes a housing having an open end. A sealing member is mounted movably in the open end of the housing. The sealing member is adapted to move from a closed position sealing the open end of the housing to an open position enabling discharge of toner from the open end of the housing. A member, in engagement with the sealing member, resiliently urges the sealing member from the open position to the closed position.

Pursuant to another aspect of the present invention, there is provided an apparatus for storing a supply of particles and discharging particles into a developer unit of an electrophotographic printing machine. The apparatus includes a container for storing a supply of particles therein. The container comprises the housing having an open end. A sealing member is mounted movably in the open end of the housing. The sealing member is adapted to move from a closed position sealing the open end of the housing to an open position enabling discharge of the particles from the open end of the housing. A member, in engagement with the sealing member, resiliently urges the sealing member from the open position to the closed position. A particle dispenser cooperates with the container to receive particles being discharged from the open end of the housing when the sealing member is in the open position. The particle dispenser dispenses particles into the developer unit of the electrophotographic printing machine.

Other aspects of the present invention will become apparent as the following description proceeds and upon reference to the drawings, in which.

Figure 1:
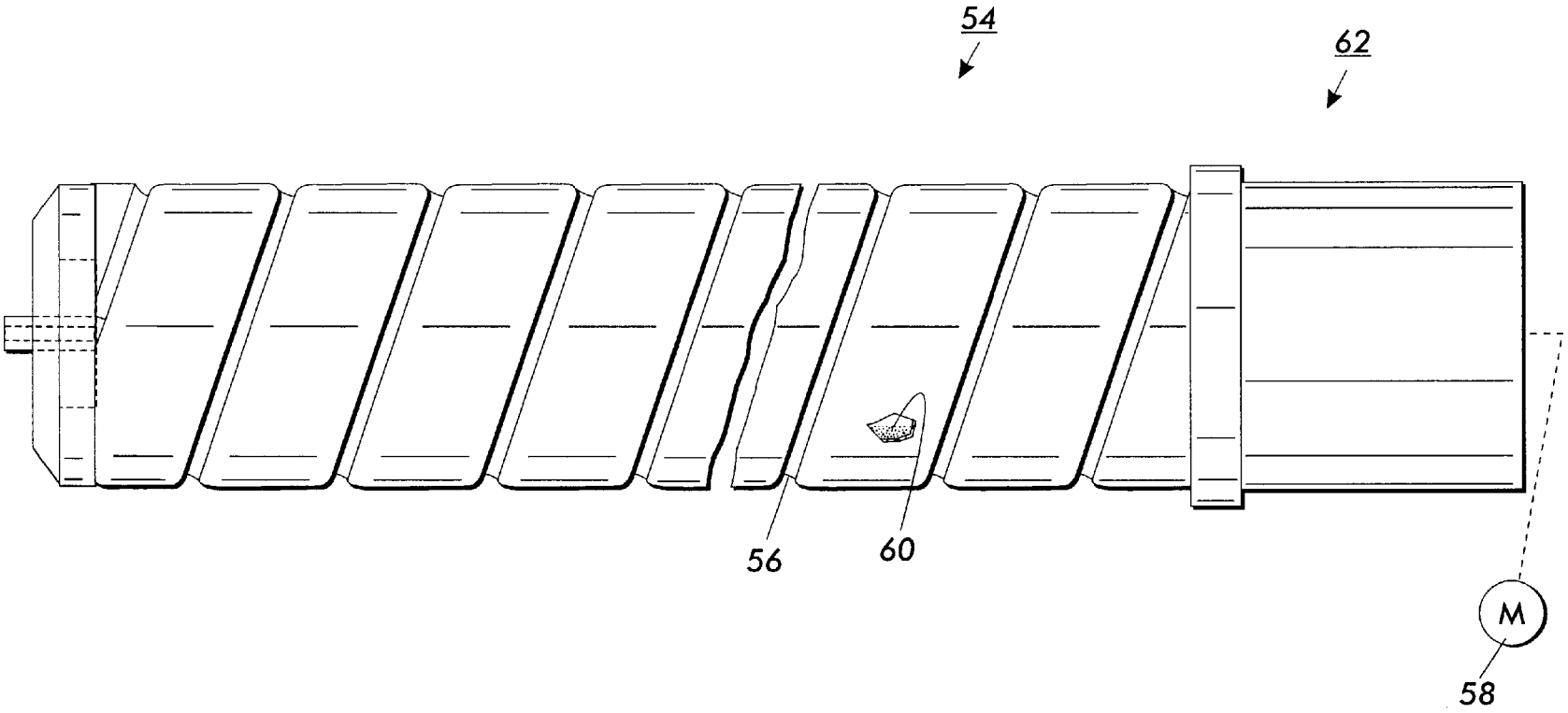
FIG. 1 is a schematic, elevational view showing the toner container of the present invention.

While the present invention will hereinafter be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

For a general understanding of the features of the present invention, reference is made to the drawings. In the drawings, like reference numerals have been used throughout to designate identical elements.

Figure 6:
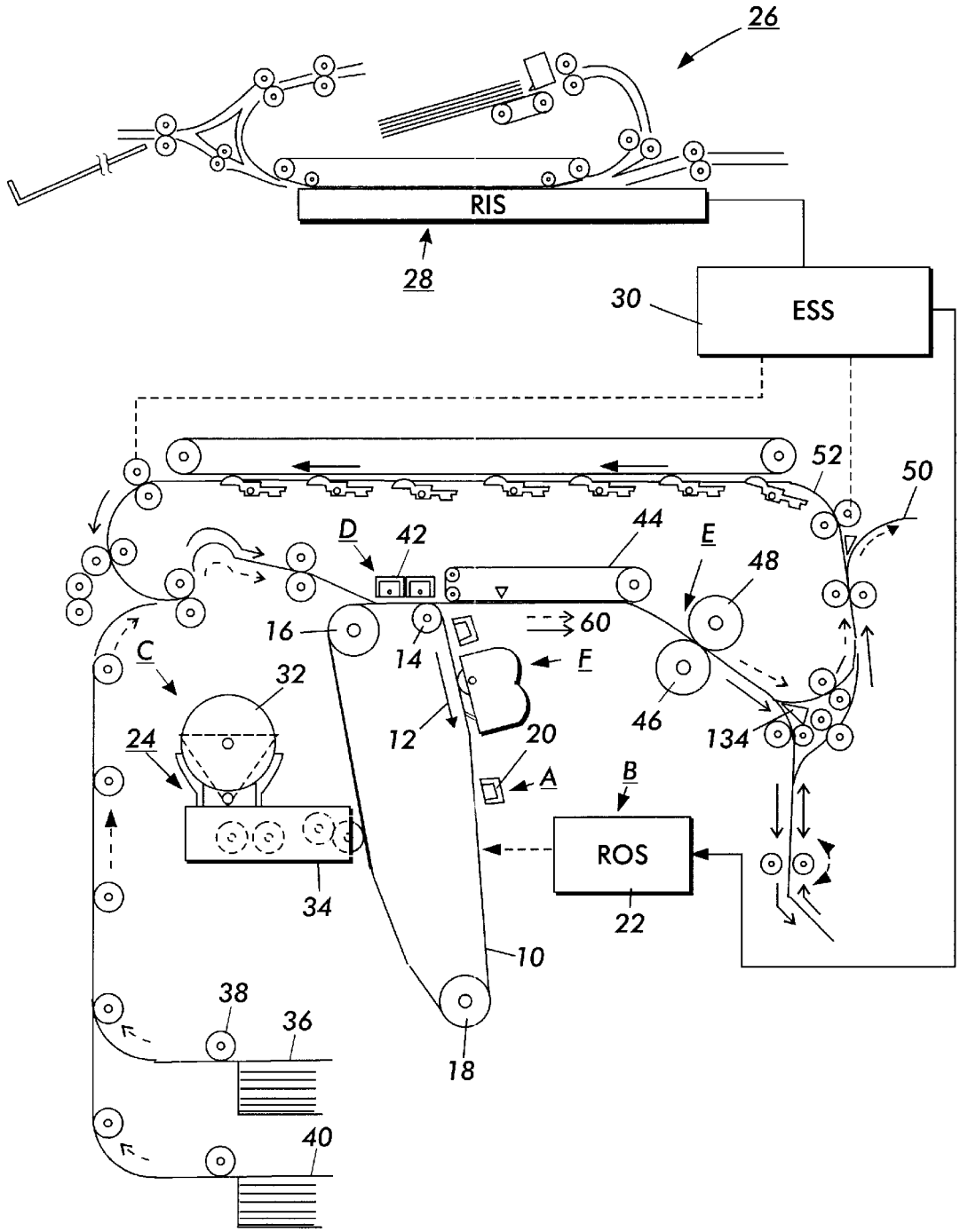
FIG. 6 is a schematic elevational view showing an electrophotographic printing machine having the toner container of the present invention mating with the toner dispenser for discharging toner particles into the developer unit.

Referring initially to FIG. 6, there is shown an electrophotographic printing machine incorporating the toner cartridge of the present invention therein. The printing machine includes a belt 10 having a photoconductive surface deposited on a conductive substrate. Any suitable photoconductive belt may be employed. Belt 10 advances successive portions of the photoconductive surface sequentially through the various processing stations disposed about the path of movement thereof. Belt 10 moves in the direction of arrow 12. Belt 10 is entrained about stripping roller 14, tensioning roller 16, and drive roller 18. As drive roller 18 rotates, it advances belt 10 in the direction of arrow 12.

Initially, belt 10 passes through charging station A. At charging station A, a corona generating device, indicated generally by the reference numeral 20, charges the photoconductive surface of belt 10 to a relatively high, substantially uniform potential.

After the photoconductive surface of belt 10 is charged, the charged portion thereof is advanced to an exposure station B. At the exposure station, an imaging beam generated by a raster output scanner (ROS) 22 illuminates the charged portion of the photoconductive surface. ROS 22 employs a laser with a rotating polygon mirror block to create an electrostatic latent image on the photoconductive surface of belt 10. This electrostatic latent image is developed by developer unit 24. An original document is positioned in a document handler 26 on a raster input scanner (RIS), generally indicated by the referenced numeral 28. RIS 28 includes document illumination lamps, optics, a mechanical scanning drive and a charge coupled device (CCD) array. The RIS captures the entire original document and converts it to a series of raster scan lines. This information is transmitted through an electronic subsystem (ESS) 30. The output from ESS 30 controls ROS 22.

Figure 2:
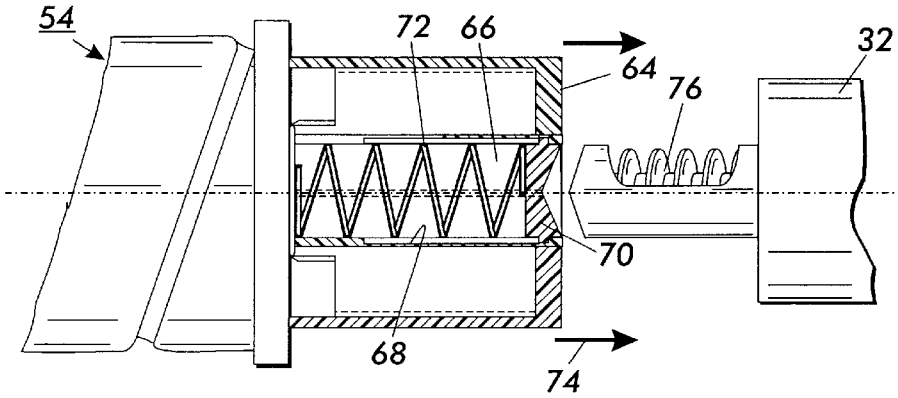
FIG. 2 is a schematic, elevational view showing the toner container being advanced toward the toner dispenser.
Figure 3:
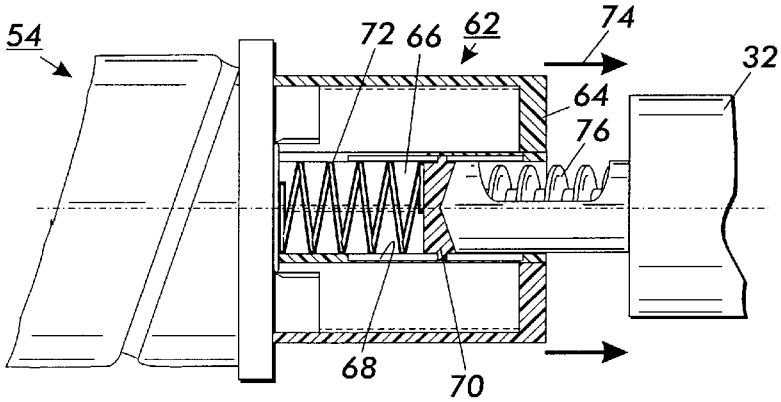
FIG. 3 shows the toner container engaging the toner dispenser and the sealing member being moved from the closed position to the open position.

At development station C, developer unit 24 develops the electrostatic latent image recorded on the photoconductive surface of belt 10. At development station C, the latent image attracts toner particles from the carrier granules forming a toner power image thereon. As successive electrostatic latent images are developed, toner particles are depleted from the developer material. A toner particle dispenser, indicated generally by the reference numeral 32 dispenses toner particles into developer housing 34 of developer unit 24. A toner cartridge, described hereinafter with reference to FIGS. 1 through 3 inclusive, is associated with the toner dispenser and furnishes additional toner particles thereto. The toner cartridge is an operator replaceable cartridge.

With continued reference to FIG. 6, after the electrostatic latent image is developed, the toner image continues to advance on belt 10 to transfer station D. At transfer station D, a sheet of support material is advanced from a stack 36 by sheet feeders 38. Alternatively, the sheet of support material may be advanced from stack 40. In either case, the sheet of support material is advanced to transfer station D in registration with the toner image on belt 10. A corona generating device 42 sprays ions on to the back side of the sheet of support material. This attracts the developed image from the photoconductive surface of belt 10 to the sheet of support material. A vacuum transport 44 moves the sheet of support material, in the direction of arrow 60, to fusing station E.

Fusing station E includes a heated fuser roller 46 and a backup or pressure roller 48. The backup roller is resiliently urged into engagement with the fusing roller to form a nip through which the sheet passes. In the fusing operation, the toner particles coalesce and bond to the sheet in image configuration forming a copy thereof. After fusing, the finished sheet is discharged along path 50. Alternatively, the finished sheet may be returned to transfer station D along path 52 with the opposite side positioned to be in engagement with the photoconductive surface of the belt so as to form a duplex copy. In any event, the simplex or duplex sheets are then finally advanced along path 50 to a catch tray with subsequent removal therefrom by the operator.

Invariably, after the sheet is separated from the photoconductive surface of belt 10 at the transfer station, some residual particles remain adhering thereto. These residual particles are removed from the photoconductive surface at cleaning station F. Cleaning station F includes a pair of rotatably mounted fiber brushes or a rotating brush and a blade which are electrically biased to attract particles from the photoconductive surface. The brushes are in contact with the photoconductive surface. Subsequent to cleaning, a discharge lamp, not shown, floods the photoconductive surface with light to dissipate any residual or electrostatic charge remaining thereon prior to the charging thereof for the next successive imaging cycle.

Turning now to FIG. 1, there is shown the toner cartridge, indicated generally by the reference numeral 54, used in the FIG. 6 printing machine. Toner cartridge 54 is of a generally cylindrical shape and includes spiral ribs 56 molded therein. Spiral ribs 56 are formed in the periphery of container 54. A cartridge having such integral spiral ribs is described in U.S. Pat. No. 5,495,323 issued to Meetze, Jr., the relevant portions thereof incorporated herein by reference. Cartridge 54 may be supported by supports (not shown) when in the printing machine in the operative position wherein cartridge 54 is mating with the toner dispenser of the developer unit. When so mounted, motor 58 is coupled to cartridge 54 and rotates toner cartridge 54. Spiral ribs 56 urge toner particles 60 toward end cap 62. End cap 62 seals toner cartridge 54. The details of end cap 62 and the manner in which it discharges toner particles when mating with the extraction auger of the toner dispenser will be described hereinafter with reference to FIGS. 2 through 4, respectively. Toner cartridge 54 may be made of any suitable durable material and may be, for example, made of acetyl or polyethylene. It may also be made of glass filled polycarbonate. The toner cartridge may be made by any suitable method such as, for example, by blow molding using a suitable blow molding process. Such a process is described in U.S. Pat. No. 4,101,617 issued to Friedrich, the relevant portions thereof incorporated herein by reference. To permit particles 60 to exit cartridge 54, cap 62 has a dispensing port therein. The details of the dispensing port will be described hereinafter once again with reference to FIGS. 2 through 4, Referring now to FIG. 2, there is shown end cap 62 in greater detail. As shown thereat, end 64 of end cap 62 is a solid disc having an aperture 66 therein. Guide rails 68 are provided in end cap 62. Plug 70 is mounted on the guide rails and is adapted to slide thereon. A plurality of guide rails form a frame for supporting plug 70 and spring 72. Spring 72 is preferably a coil spring. As the operator moves toner cartridge 54 in the direction of arrow 74, the extraction auger 76 extending from toner dispenser 32 engages plug 70. This is shown more clearly in FIG. 3.

Returning now to FIG. 3, as the operator continues to move cartridge 54 in the direction of arrow 74, plug 70 moves in the opposite direction or does not move with respect to dispenser 32 sliding along guide rails 68. This causes spring 72 to compress. In this way, an aperture is formed in end cap 62 to permit the dispensing of toner particles into extraction auger 76 and the advancement thereof into toner dispenser 32. Toner dispenser 32 discharges the toner particles into the housing 34 of the developer unit. Thus, plug 70 moves from a position sealing or closing aperture 66 to a position opening aperture 66 and permitting the discharge of particles into auger 76.

Figure 4:
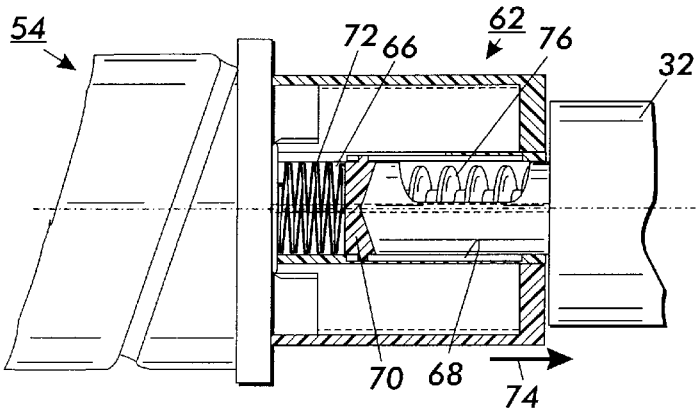
FIG. 4 shows the toner dispenser and the toner container in the operative position with the sealing member being in the open position enabling toner particles to be discharged from the toner container into the toner dispenser.

Referring now to FIG. 4, there is shown plug 70 in the fully retracted position completely opening aperture 66. As shown thereat, spring 72 is completely compressed and extraction auger 76 is fully inserted into end cap 62. In this position, as container 54 rotates, ribs 56 advance the toner particles into the aperture 66 enabling extraction auger 76 to receive these toner particles and to advance them to toner dispenser 32. After toner cartridge 54 is depleted of toner particles, the operator moves toner cartridge 54 in the opposite direction to arrow 74. In this way, spring 72 slides plug 70 in the direction of arrow 74 so as to seal the aperture in end cap 62 when extraction auger 76 is fully removed therefrom. It is thus seen that the plug is retractable in that it slides from a closed position sealing the toner cartridge to an open position enabling toner particles to be dispensed therefrom and then returns to the closed position sealing the toner cartridge after the toner particles have been depleted therefrom. This insures that the operator will not be dirtied by toner particles escaping from the toner cartridge, and, more importantly, that the printing machine will not be contaminated.

Figure 5:
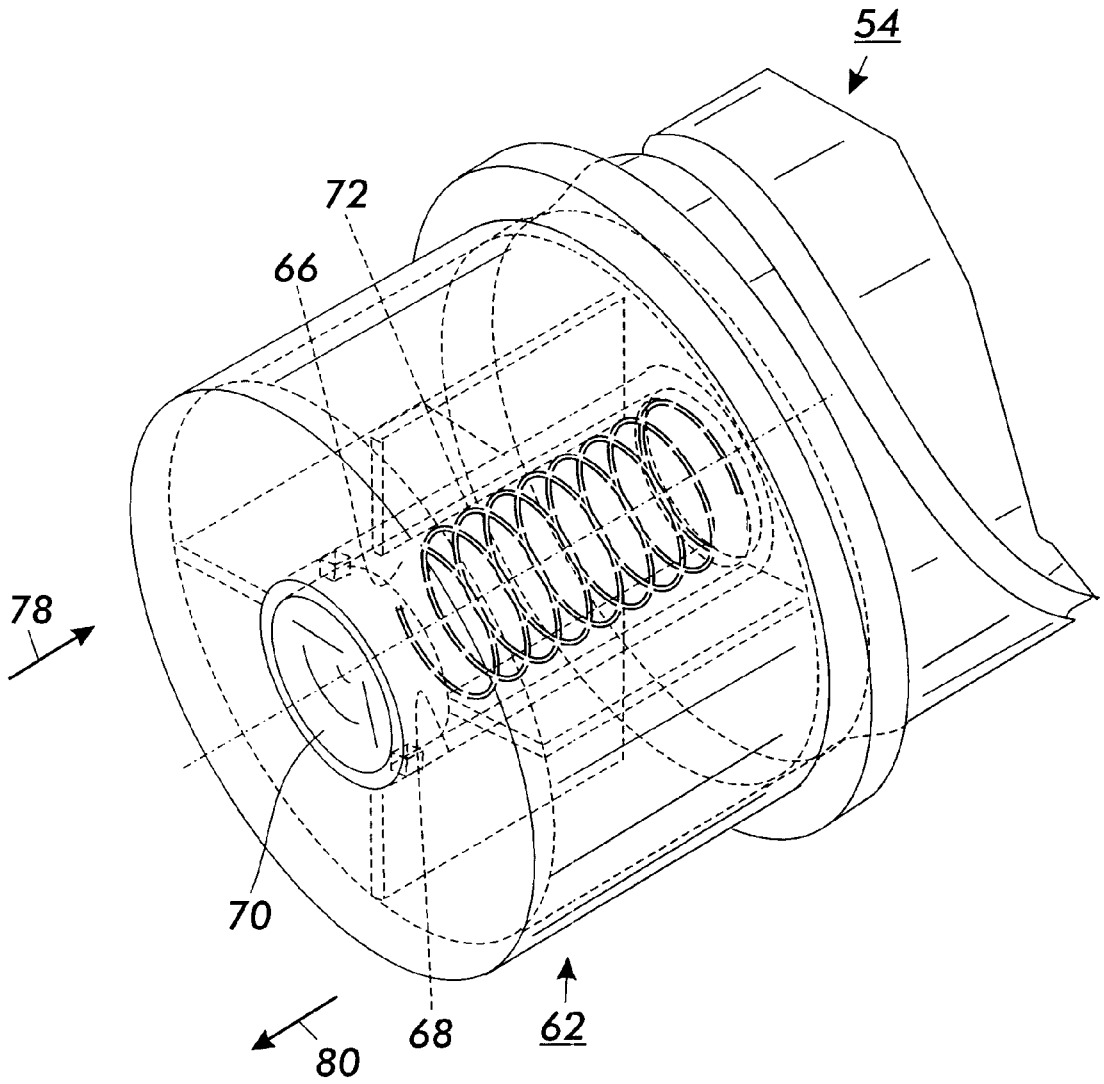
FIG. 5 is a fragmentary perspective view showing the end cap of the toner container and the sealing arrangement therein.

Turning to FIG. 5, there is shown a perspective view of a portion of toner cartridge 54 and end cap 62. As shown thereat, spring 72 is mounted in aperture 66 with plug 70 mounted therein as well to seal the opening therein. Plug 70 is mounted slidably on guide rails 68. As plug 70 moves in the direction of arrow 78, spring 72 compresses and aperture 66 opens. This enables toner particles to be discharged from cartridge 54. When toner cartridge 54 is depleted of toner particles, spring 72 moves plug 70 in the direction of arrow 80 to return plug 70 to a position in which it seals aperture 66 preventing the dispensing of toner particles from cartridge 54.

In recapitulation, it is clear that the present invention is directed to a toner cartridge having a retractable end seal which seals the cartridge when not in the printing machine and opens in response to the cartridge being placed in the printing machine. The seal is a slidably mounted plug in the end cap which moves from a closed position, when the cartridge is remote from the printing machine, to an open position, when the cartridge is in the operative position in the printing machine.

It is, therefore, apparent that there has been provided in accordance with the present invention, a toner cartridge for use in the development unit of an electrophotographic printing machine which fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications, and variations that fall within the spirit and broad scope of the appended claims.

What is claimed is:

1. A container for storing a supply of toner therein, including:

a housing having an open end;

an end cap mounted fixedly in the open end of said housing, said end cap having an aperture extending therethrough;

a sealing member mounted movably in the aperture of said end cap, said sealing member being adapted to move from a closed position sealing the open end of said housing to an open position enabling discharge of toner from the open end of said housing; and a member, in engagement with said sealing member, to urge said sealing member from the open position to the closed position.

2. A container according to claim 1, wherein said member includes a spring mounted in the aperture of said end cap with one end in engagement with said sealing member to resiliently urge said sealing member from the open position to the closed position sealing the aperture in said end cap.

3. A container according to claim 2, wherein said sealing member is mounted slidably in the aperture of said end cap.

4. A container according to claim 3, wherein said spring includes a coil spring which compresses as said sealing member slides from the closed position to the open position.

5. An apparatus for storing a supply of particles and discharging particles into a developer unit of an electrophotographic printing machine, including:

a container for storing a supply of particles therein, said container comprising a housing having an open end, and an end cap mounted fixedly in the open end of said housing, said end cap having an aperture extending therethrough, a seating member mounted movably in the aperture of said end cap, said sealing member being adapted to move from a closed position sealing the open end of said housing to an open position enabling discharge of particles from the open end of said housing, and a member, in engagement with said sealing member, to urge said sealing member from the open position to the closed position; and a particle dispenser, cooperating with said container to receive particles being discharged from the open end of said housing when said sealing member is in the open position, to dispense particles into the developer unit of the electrophotographic printing machine.

6. An apparatus according to claim 5, wherein said particle dispenser includes an extraction auger, said container being moved toward said extraction auger so that said extraction auger engages said sealing member and moves said sealing member from the closed position to the open position enabling particles to be discharged from the aperture in said end cap and be received by said extraction auger for dispensing into the developer unit of the electrophotographic printing machine.

7. An apparatus according to claim 6, wherein said member includes a spring mounted in the aperture of said end cap with one end in engagement with said sealing member to resiliently urge said sealing member to the closed position sealing the aperture in said end cap.

8. An apparatus according to claim 7, wherein said sealing member is mounted slidably in the aperture of said end cap, said extraction auger engages said sealing member to slide said sealing member from the closed position to the open position so as to enable said extraction auger to receive particles advancing through the aperture in said end cap.

9. An apparatus according to claim 8, wherein said spring includes a coil spring which compresses as said container moves said sealing member into engagement with said extraction auger and said sealing member slides from the closed position to the open position.

* * * * *